US007654335B2

(12) United States Patent
Stratton

(10) Patent No.: US 7,654,335 B2
(45) Date of Patent: Feb. 2, 2010

(54) SYSTEM AND METHOD FOR CONTROLLING AN IMPLEMENT BASED UPON A GEAR SHIFT

(75) Inventor: Kenneth Lee Stratton, Dunlap, IL (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 685 days.

(21) Appl. No.: 11/349,165

(22) Filed: Feb. 8, 2006

(65) Prior Publication Data

US 2007/0181361 A1 Aug. 9, 2007

(51) Int. Cl.
*A01B 63/111* (2006.01)

(52) U.S. Cl. ..... 172/4.5; 172/2

(58) Field of Classification Search ..... 172/2, 172/3, 4, 4.5
See application file for complete search history.

(56) References Cited

U.S. PATENT DOCUMENTS 4,273,196 A * 6/1981 Etsusaki et al. ..... 172/4.5
4,846,283 A * 7/1989 Batcheller ..... 172/10
4,852,657 A * 8/1989 Hardy et al. ..... 172/2
5,287,280 A * 2/1994 Yamamoto et al. ..... 701/84
5,297,649 A * 3/1994 Yamamoto et al. ..... 180/197
5,560,431 A 10/1996 Stratton
5,564,507 A * 10/1996 Matsushita et al. ..... 172/3
6,086,509 A * 7/2000 Johnson et al. ..... 477/97
6,317,676 B1 * 11/2001 Gengler et al. ..... 701/82
6,879,899 B2 * 4/2005 Budde ..... 701/50

* cited by examiner

*Primary Examiner*—Thomas B Will
*Assistant Examiner*—Joel F Mitchell
(74) *Attorney, Agent, or Firm*—Finnegan, Henderson, Farabow, Garrett & Dunner, LLP

(57) ABSTRACT

Systems and methods for controlling an implement based upon a gear shift include a shift detector circuit which detects a direction of the gear shift and an implement controller circuit which adjusts an implement in response to the direction of the gear shift.

19 Claims, 5 Drawing Sheets

SYSTEM AND METHOD FOR CONTROLLING AN IMPLEMENT BASED UPON A GEAR SHIFT

TECHNICAL FIELD

The present disclosure relates generally to a control system for automatically controlling an implement associated with a machine and, more particularly, to a control system for controlling an implement on an earthmoving machine by anticipating a gear shift of a transmission on the machine.

BACKGROUND

Earthmoving machines (e.g., a track type tractor commercially available from Caterpillar Inc.) having earthmoving implements (e.g., a blade, such as a bulldozer blade) are used on worksites in order to alter a landscape of a section of land. The implement may be controlled by an operator of the machine to perform work on the worksite. For example, the operator may move a lever that controls the movement of the implement through hydraulic mechanisms coupled to the implement. Specifically, if an operator moves a lever within the machine, the movement of the lever translates into an electrical signal supplied to the hydraulic mechanisms. The electrical signal causes the hydraulic mechanisms to move, thereby transferring hydraulic pressure within a cylinder of the hydraulic mechanism. Because the hydraulic mechanisms are coupled to the implement, the transfer of pressure within the cylinder causes the implement to move in a manner consistent with the movement of the lever by the operator.

In addition to the hydraulic mechanisms, earthmoving machines also have a conventional engine and transmission, including gears, to maintain optimal performance of the engine. The transmission may be manual, in which the operator can physically change transmission gears with a clutch and gear shifter or lever. Alternatively, gears can be shifted electronically, in which the operator depresses appropriate buttons on a control panel, for example, to generate corresponding electrical signals to carry out a gear shift. Optionally, the operator may actuate a lever, which activates known circuitry to supply the gear shifting electrical signals. Electronic control transmissions change gears of the transmission through electronic control systems, such as a controller area network (CAN) as described in greater detail below.

Fixed gear transmissions often require synchronization of clutch disengagement, gear shift, and clutch reengagement to shift from one gear to another. Such synchronization, coupled with the weight of the machine, causes the machine to pitch or tilt when gears are shifted. The pitching can create instability in the implement position, causing the implement to move up or down in an uncontrolled manner. Moreover, if the implement is close to the ground and a down shift occurs, the implement may gouge the surface of the worksite.

In addition, when earthmoving machines perform coverage duties, such as covering a section of the worksite with material (e.g., loose rock), the machine typically operates more efficiently at a higher gear to empty and spread contents in the implement across the worksite. However, as contents are emptied and the operator switches to the higher gear, the machine may pitch upward thereby causing undesired spillage and uneven coverage of the material. Accordingly, to maintain even coverage, the operator may operate the machine in one gear, thereby decreasing efficiency.

The above-noted shortcomings can be overcome by manually operating the implement in compensatory manner to counteract the pitching of the machine. For example, if the operator shifts the machine from first gear to second gear, the operator may also simultaneously raise the implement to prevent gouging the surface of the worksite. Manual adjustment, however, requires that operators be experienced and skilled in knowing when and to what extent the implement should be moved during a gear shift. Moreover, since the hydraulic mechanism must first fill with fluid in order to move the implement, the implement may not respond fast enough to the operator's attempts to offset gear shift-related changes in implement position.

In addition, if so-called "control gains" associated with the electrical signals that control the hydraulic mechanism are low, the hydraulic mechanisms react slowly to the operator's controls, and may further hinder the operator's efforts to compensate undesired movement of the implement.

Although techniques are known for controlling implement position, none compensate effectively for implement movement during a gear shift, as discussed above. For example, U.S. Pat. No. 5,560,431 to Stratton et al. discloses an automatic control system of an implement, such as an implement, that accounts for changing ground profiles. The system of Stratton et al. detects a true ground speed of an earthmoving machine (e.g., a tractor). The system also senses an angular rate of the machine and senses the position of a lift actuator included with an earthmoving implement (e.g., a dozer blade). Based on such information, the system determines a slip rate value of the machine and a position of the implement as a function of the slip rate value, the angular rate, and the lift position. The position of the implement is then adjusted based upon this function. Stratton et al., however, does not adjust the implement in response to a gear shift of the transmission, and is thus susceptible to undesired implement movement, as discussed above.

The disclosed system is directed at overcoming one or more of the shortcomings in the existing technology.

SUMMARY OF THE INVENTION

In accordance with one aspect of the invention, there is provided a system for automatically adjusting an implement. The system includes a shift detector circuit configured to detect a direction of a gear shift from a gear engaged with an engine to a desired gear, before the desired gear is engaged with the engine, wherein the shift detector circuit outputs an electrical signal representative of the direction of the gear shift. The system also includes an implement controller circuit configured to receive the electrical signal and adjust a position of the implement in response to the electrical signal.

According to another aspect of the invention there is provided a method for automatically adjusting an implement. The method includes determining a direction of a gear shift of a transmission based upon a desired gear and a gear of the transmission engaged with an engine before the desired gear is engaged with the engine. The method also includes automatically adjusting the implement in response to the direction of the gear shift.

DETAILED DESCRIPTION

Figure 1:
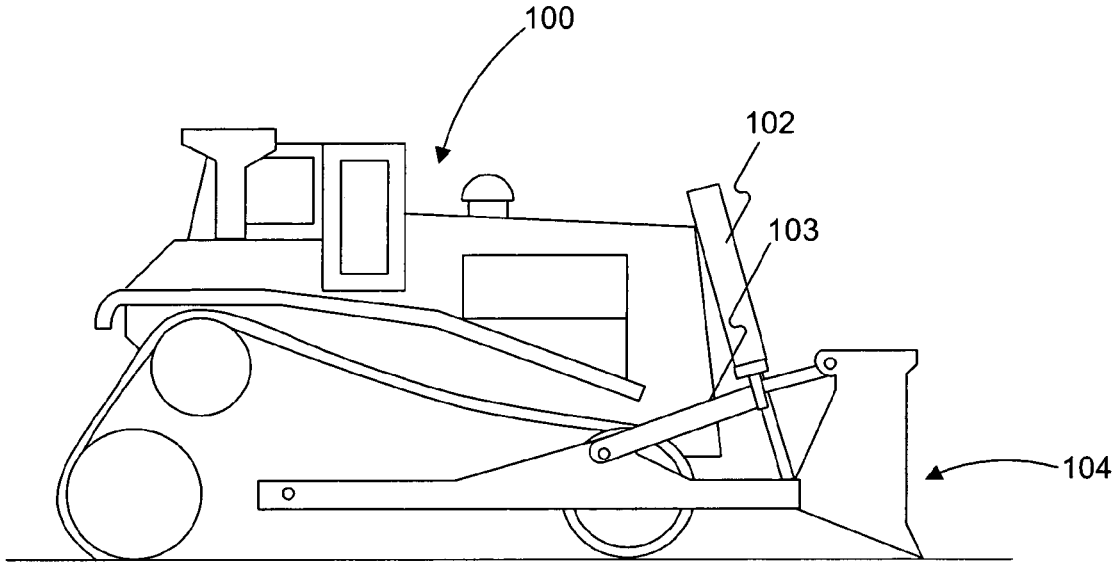
FIG. 1 illustrates an earthmoving machine in which embodiments of the present system may be implemented.

FIG. 1 illustrates a tractor 100 including hydraulic mechanisms 102 and 103 and an implement 104, such as a blade.

As tractor 100 operates on a worksite, hydraulic mechanisms 102 and 103 may operate to direct a motion of implement 104. For example, hydraulic mechanism 102, which may include a lift actuator, moves implement 104 between an up position and a down position. In addition, hydraulic mechanism 103, which may include a tilt actuator that tilts implement 104 forward and backward. Hydraulic mechanisms 102 and 103 may operate in accordance with electrical signals supplied thereto from internal devices within tractor 100 (not shown). For example, electrical signals may actuate hydraulic mechanism 102 to move up and down, while other electrical signals may cause hydraulic mechanism 103 to move forward and backward.

Figure 2A:
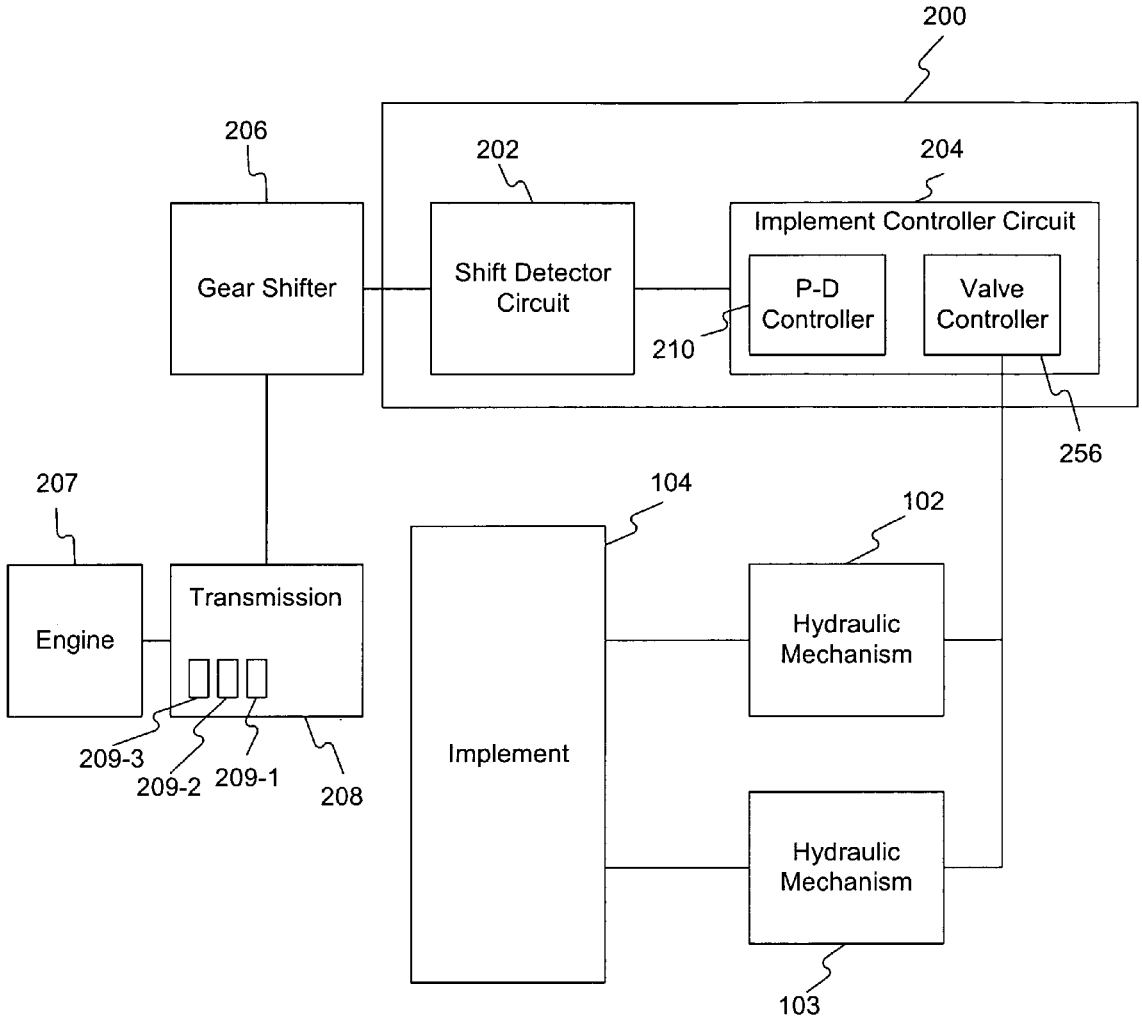
FIG. 2A illustrates a control system consistent with one exemplary embodiment.

Referring now to FIG. 2A, a control system 200 for adjusting an implement of a machine in anticipation of a gear shift will now be described. Control system 200 may be included within tractor 100 of FIG. 1, and includes shift detector circuit 202 and implement controller circuit 204. Implement controller circuit 204 may also include a proportional-derivative (P-D) controller 210 and a valve controller 256. FIG. 2A also shows known gear shifter 206, transmission 208, and gears 209-1, 209-2, and 209-3 as part of transmission 208.

As further shown in FIG. 2A, gear shifter 206 operates to shift gears 209 in transmission 208. Initially, an operator designates a desired gear, e.g., gear 209-1, with gear shifter 206 in a known manner. Transmission 208 then changes or shifts the gear currently engaged with engine 207, i.e., the actual gear, e.g., gear 209-2, to the desired gear after a delay. The desired gear then becomes the actual gear. Meanwhile, shift detector circuit 206 detects that the desired gear has been selected, typically before transmission 208 actually shifts to the desired gear. Shift detector circuit 206 also detects a direction of the gear shift by comparing the actual gear before the shift occurs to the desired gear.

In machines in which transmission 208 is electrohydraulic, electrical signals are supplied from gear shifter 206 to transmission 208 to change gears 209, and may also be directed toward shift detector 202 so that the desired gear, as well as the direction of the gear shift, may be determined before the desired gear is engaged with engine 207. Such electrical signals may be output in accordance with a conventional controller area network (CAN), which defines protocols and other transmission requirements for electronically exchanging information between various components of a machine.

In machines in which gears are shifted manually, sensors may be provided in gear shifter 206 to detect and output corresponding electrical signals, which are then received by shift detector circuit 202. Shift detector circuit 202, in turn, determines the desired gear in response to such signals.

In response to signals received from gear shifter 206, shift detector 202 may send a first electrical signal to implement controller circuit 204 indicating that the operator has directed the machine to the desired gear, as well as indicating the direction of the gear shift. The first electrical signal may be sent during the above-noted delay period between the operator's selection of the desired gear and a time at which the desired gear is engaged with engine 207. In response to the received first electrical signal, implement controller 204 may send second electrical signals to hydraulic mechanisms 102 and 103 to raise or lower implement 104. For example, as noted above, after transmission 208 shifts from a low gear to a high gear, machine 100 typically pitches up, resulting in uneven ground coverage or causing materials in implement 104 to spill. Based upon the desired gear, implement controller 204, however, adjusts implement 104 downward to offset any upward motion of implement 104 caused by such pitching.

Also, if a down-shift occurs, that is, if the gear shift occurs from a higher gear to a lower gear, the machine may tend to pitch downward causing the implement to gouge the ground. Accordingly, implement controller 204 outputs the second electrical signals to direct hydraulic mechanisms 102 and 103 so that implement 104 is raised upon detection of such down-shifting. Accordingly, the implement remains in approximately the same position relative to the ground.

Preferably, hydraulic mechanisms 102 and 103 should respond within the delay period between the operator directing the gear shifter 206 to the desired gear and transmission 208 shifting to the desired gear. Accordingly, hydraulic mechanisms 102 and 103 must respond relatively quickly to the second electrical signals output from implement controller 204 in order to effectively offset undesired movement of implement 104, as discussed above. Typically, the response of the hydraulic mechanisms to the second electrical signals output from implement controller 204 is in accordance with a so-called "proportional control gain," and "derivative control gain" determined by P-D controller 210. In order to decrease response time, these control gains are temporarily increased so that hydraulic mechanism 102 and 103 can react fast enough to correct the position of implement 104. In particular, the proportional ($K_p$) and derivative ($K_d$) control gains are increased in the following formula:

$$\text{Control signal}=K_p*e_{bh}+K_d*d(e_{bh})/dt$$

In the above equation, $K_p$ is the proportional control gain, $e_{bh}$ is an indication of an error between a target blade height and an actual blade height, $K_d$ is the derivative control gain, and $d(e_{bh})/dt$ is an instantaneous rate of change of the error. Accordingly, the magnitude of the second electrical signal is correspondingly increased when both $K_p$ and $K_d$ are increased or the d/dt error rate changes. It is noted that although response time is quicker when $K_p$ and $K_d$ are increased, hydraulic mechanisms 102 and 103 are more difficult to control under these circumstances and may become unstable. Thus, if desired, implement controller circuit 204 outputs second electrical signals with lower control gains after the transmission shifts gears so that more precise movement of implement 104 can be achieved.

Although automatic control of implement 104 has been described above, improved manual control of implement 104 can also be achieved consistent with an additional aspect of the present disclosure. In particular, standby flow can be provided in response to a detected gear shift so that hydraulic mechanisms 102 and 103 can react faster to the operator's controls. Such standby hydraulic flow will next be described.

Typically, hydraulic mechanisms 102 and 103 include cylinders, which fill with hydraulic fluid. Displacement of the hydraulic fluid in a predetermined manner within the cylinders results in expansion and contraction of hydraulic mechanisms 102 and 103. Often actuation of the hydraulic mechanisms 102 and 103 may be delayed while hydraulic fluid is supplied thereto to reach a required fill level. Several means are well known in the art to increase hydraulic response. Unfortunately, when used continuously, the means used to increase response will adversely affect efficiency and/or a high temperature capability. However, the response can be increased temporarily without significant adverse affects. These means may include 1) increasing standby pressure, 2) increasing available flow, or 3) activating the hydraulic current to "prime" the cylinder. Accordingly, consistent with a further aspect of the present disclosure, implement controller 204 may control hydraulic mechanisms 102 and 103 to prefill the cylinder hydraulic fluid. As a result, hydraulic fluid flows, i.e., an additional flow is applied, to hydraulic mechanisms 102 and 103 upon detection of a gear shift. This may be achieved by slightly raising implement 104 (i.e., "priming" or "stroking" hydraulic mechanisms 102 and 103). Although slightly raising implement 104 to prime hydraulic mechanisms 102 and 103 may not by itself adequately avoid gouging, hydraulic mechanisms 102 and 103 can respond to the operator's controls with less delay. The operator can therefore manually compensate undesired movement of implement 104.

The present disclosure is also applicable to automatic control systems such as Caterpillar Inc.'s AccuGrade™ Laser Grade Control System. In particular, upon the operator directing the machine to a desired gear, engagement of the desired gear with engine 207 may be automatically delayed for a period of time to allow an automatic implement control system to further control implement 104.

Figure 2B:
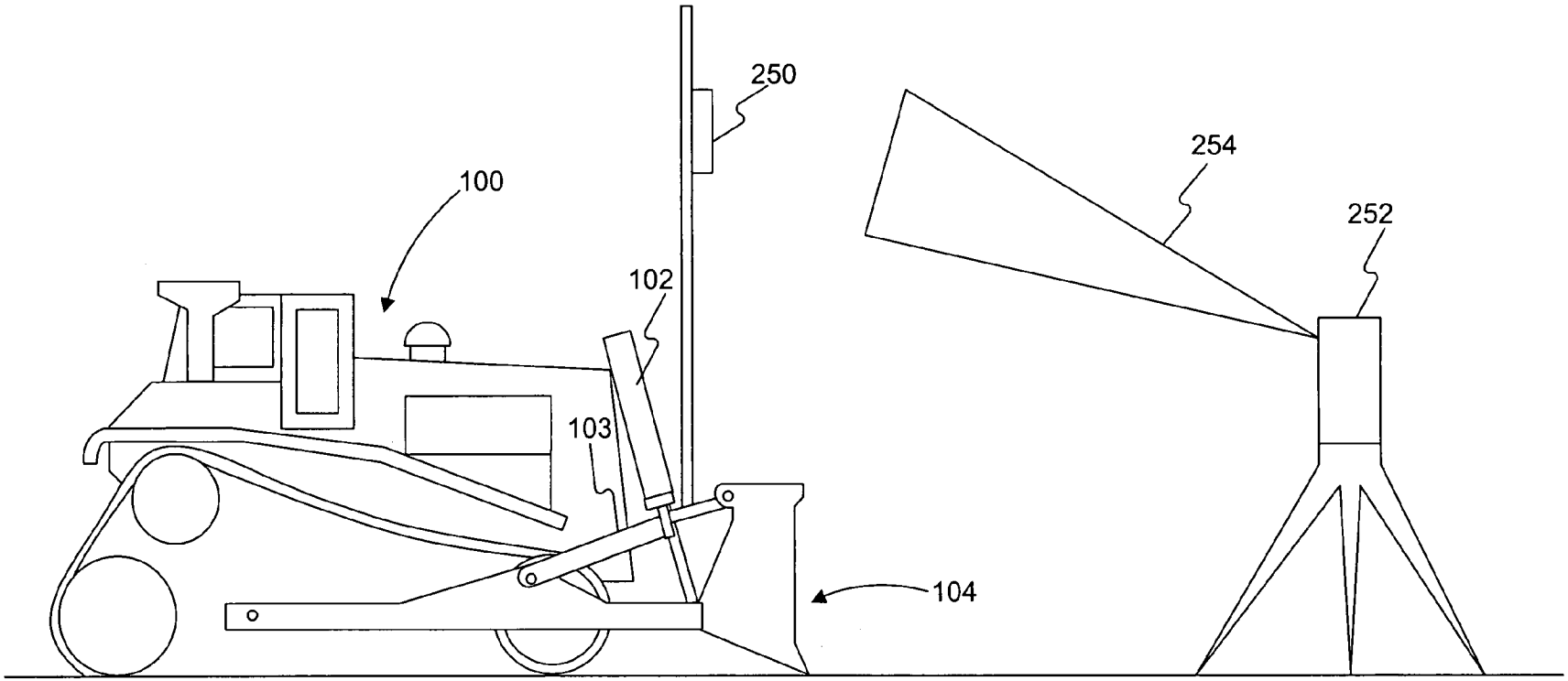
FIG. 2B illustrates an earthmoving machine having an automatic implement control system.
Figure 2C:
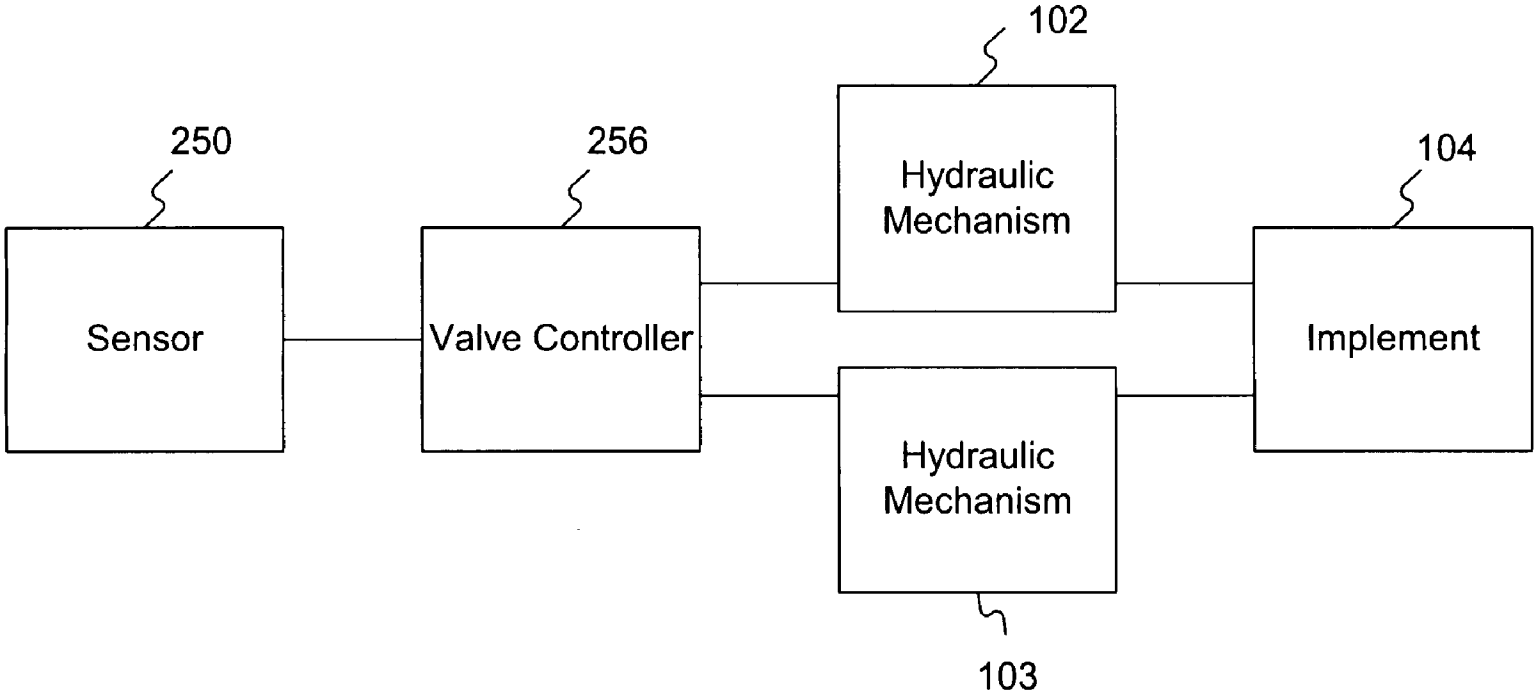
FIG. 2C illustrates a block diagram of a control system consistent with one exemplary embodiment.

An example of an automatic implement control system is shown in FIG. 2B including machine 100 with a sensor 250. Also shown in FIG. 2B is surveying equipment 252, and a survey signal 254. Surveying equipment 252 sends survey signal 254, which is received by sensor 250. Survey signal 254 may include position data, such as a vertical position. Sensor 250 receives survey signal 254 and, as shown in FIG. 2C, sends an electronic signal to valve controller 256. Valve controller 256 may require additional time to calculate an appropriate vertical position of implement 104 based on survey signal 254 and adjust hydraulic mechanisms 102 and 103 accordingly. As a result, when the desired gear is engaged, implement 104 is positioned in such a manner to offset undesired gearshift-related movement while under control of the automatic implement control system.

It is noted that valve controller 256 may also be incorporated in control system 200 as part of implement controller circuit 204 shown in FIG. 2A. The amount of hydraulic anticipation that is provided by this invention may be determined empirically or by modeling machine dynamics.

INDUSTRIAL APPLICABILITY

Figure 3:
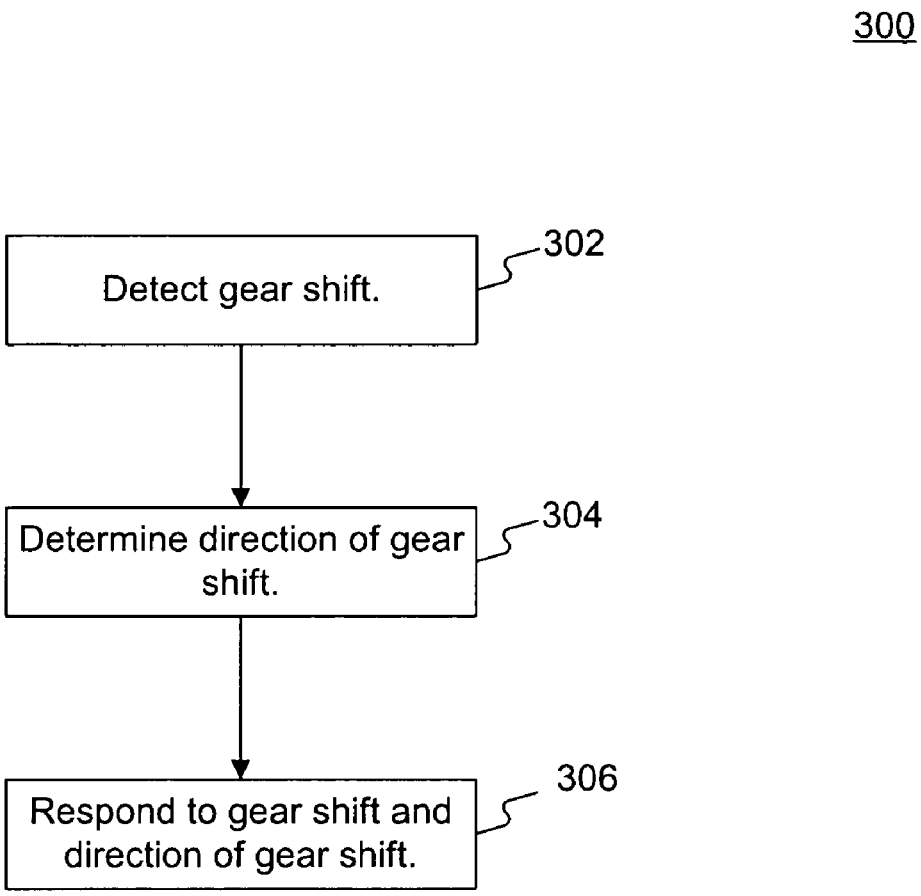
FIG. 3 is flowchart illustrating a method for controlling an implement based upon a gear shift consistent with one exemplary embodiment.

Referring now to the operation, FIG. 3 illustrates a flowchart for a method 300 for adjusting an implement by anticipating a gear shift.

At stage 302, a determination is made of a desired gear selected by an operator. The desired gear may be the gear in which an operator of the machine desires to operate the machine. For machines having electronic control transmissions, an electrical signal representing the desired gear may be carried by a data link using CAN. For machines having a manual control transmission, the desired gear may be determined when the gear lever is shifted by the user into another gear shift position, by for example, sending the electrical signal representing the desired gear to a shift detector circuit 206.

At stage 304, a direction of the gear shift may be determined by shift detector circuit 202 which may receive the electrical signal representing the direction of the gear shift. The direction of the gear shift may be determined by comparing the desired gear to the actual gear during a delay before the desired gear engages engine 207. The direction may either be up, for example, in which transmission 208 is shifted from a first low gear to a higher second gear, or down, for example, from a high gear to a lower gear.

At stage 306, control system 200 of machine 100 responds to the operator's designation of the desired gear and a direction of the gear shift. The response may be a number of operations by control system 200 in order to accurately control the implement. For example, control system 200 may cause implement 104 to be raised or lowered in response to a gear shift.

Alternatively, control system 200 may cause implement 104 to be slightly raised in order to provide standby hydraulic fluid flow in the hydraulic mechanisms (e.g., hydraulic mechanisms 102 and 103). Accordingly, as noted above, the hydraulic mechanisms can respond quickly to facilitate automatic adjustment of the position of the implement in response to a gear shift.

Further, the control gains supplied to the control system (e.g., implement controller 204) may be increased. Accordingly, as noted above, the hydraulic mechanisms can respond more quickly to facilitate automatic adjustment of the position of the implement in response to a gear shift.

In addition, as noted above with respect to FIGS. 2B and 2C, the present control system disclosed herein may be integrated with an automatic implement control system. In which case, the gear shift may be delayed to permit the automatic control system to provide additional control of the implement position.

Advantages over the existing technology include an automated system for anticipating a gear shift on a machine and controlling the operation of the implement to prevent undesirable actions, such as gouging of the worksite.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for automatically adjusting an implement, the system comprising:

a shift detector circuit configured to detect a direction of a gear shift from a gear engaged with an engine to a desired gear, before the desired gear is engaged with the engine, wherein the shift detector circuit outputs a first electrical signal representative of the direction of the gear shift; and an implement controller circuit configured to receive the first electrical signal and to output a second electrical signal to adjust a position of the implement in response to the first electrical signal, wherein the implement controller circuit is further configured to automatically increase one or more control gains associated with the second electrical signal on a temporary basis in response to the first electrical signal to adjust the position of the implement.

2. The system of claim 1, wherein the implement controller circuit outputs the second electrical signal to a hydraulic mechanism to lower the implement when the direction of the gear shift is an upshift.

3. The system of claim 1, wherein the implement controller circuit outputs the second electrical signal to a hydraulic mechanism to raise the implement when the direction of the gear shift corresponds to a downshift.

4. The system of claim 1, wherein the one or more control gains include a proportional gain or a derivative gain.

5. The system of claim 1, wherein the implement controller is configured to direct standby hydraulic fluid flow to a hydraulic mechanism in response to the second electrical signal outputted by the implement controller circuit.

6. The system of claim 5, wherein the hydraulic mechanism controls movement of the implement.

7. The system of claim 1, wherein the implement controller circuit includes a valve controller, included as part of an automatic implement control system, to adjust the implement.

8. The system of claim 7, wherein the valve controller is configured to send an electrical signal to at least one hydraulic mechanism to automatically adjust the implement.

9. The system of claim 8, wherein engagement of the desired gear is delayed to allow the valve controller to adjust a position of the implement.

10. The system of claim 9, wherein the valve controller is further configured to adjust the position of the implement in response to a survey signal.

11. A method for automatically adjusting an implement, the method comprising:

determining a direction of a gear shift of a transmission based upon a desired gear and a gear of the transmission engaged with an engine before the desired gear is engaged with the engine;

outputting a first electrical signal associated with the direction of the gear shift;

automatically adjusting the implement in response to the first electrical signal; and automatically increasing one or more control gains, on a temporary basis, of a second electrical signal applied to a hydraulic mechanism coupled to the implement in response to the first electrical signal.

12. The method of claim 11, wherein automatically adjusting the implement includes raising the implement when the direction of the gear shift corresponds to a downshift.

13. The method of claim 11, wherein automatically adjusting the implement includes lowering the implement when the direction of the gear shift corresponds to an upshift.

14. The method of claim 11, wherein the one or more control gains include a proportional gain or a derivative gain.

15. The method of claim 11, wherein automatically adjusting the implement includes directing standby hydraulic fluid flow to a hydraulic mechanism in response to the direction of the gear shift.

16. The method of claim 11, wherein automatically adjusting the implement includes sending an electrical signal from a valve controller to at least one hydraulic mechanism coupled to the implement.

17. The method of claim 16, further including delaying engagement of the desired gear to an engine to allow the valve controller to adjust a position of the implement.

18. The method of claim 17, wherein the valve controller further adjusts the position of the implement in response to a survey signal.

19. A system for automatically adjusting an implement, the system comprising:

a shift detector circuit configured to detect a direction of a gear shift of a transmission based upon a desired gear and a gear of the transmission engaged with an engine before the gear shift occurs, wherein the shift detector circuit outputs a first electrical signal representative of the direction of the gear shift; and an implement controller circuit configured to receive the first electrical signal and adjust a position of the implement in response to the first electrical signal, wherein the implement controller circuit includes a valve controller configured to provide an electrical signal to one or more hydraulic mechanisms coupled to the implement and a proportional-derivative controller configured to control a control gain associated with the electrical signal provided to the one or more hydraulic mechanisms, wherein the implement controller circuit is further configured to temporarily increase the control gain associated with the electrical signal provided to the one or more hydraulic mechanisms.

* * * * *